US012158060B1

(12) United States Patent
Grove et al.

(10) Patent No.: US 12,158,060 B1
(45) Date of Patent: Dec. 3, 2024

(54) PERFORATING FLUID SHOCK DAMPENER

(71) Applicant: Halliburton Energy Services, Inc., Houston, TX (US)

(72) Inventors: Brenden Grove, Alvarado, TX (US); Jason Paul Metzger, Alvarado, TX (US); Richard Ellis Robey, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/222,300

(22) Filed: Jul. 14, 2023

(51) Int. Cl.
*E21B 43/116* (2006.01)
*E21B 43/119* (2006.01)

(52) U.S. Cl.
CPC ..... *E21B 43/116* (2013.01); *E21B 43/119* (2013.01)

(58) Field of Classification Search
CPC ..... E21B 43/116; E21B 43/119; E21B 43/11
See application file for complete search history.

(56) References Cited

U.S. PATENT DOCUMENTS 5,161,616 A * 11/1992 Colla ..... E21B 43/11852 166/63
8,408,286 B2 4/2013 Rodgers et al.
8,875,796 B2 11/2014 Hales et al.
9,297,228 B2 3/2016 Martinez et al.
9,598,940 B2 3/2017 Rodgers et al.
10,415,353 B2 9/2019 Robey et al.
10,731,443 B2 8/2020 Von Kaenel et al.
10,920,541 B2 2/2021 Robey et al.
10,920,542 B2 2/2021 Robey et al.
10,941,632 B2 3/2021 Robey et al.
10,954,761 B2 3/2021 Von Kaenel et al.
11,002,119 B2 5/2021 Robey et al.
11,078,761 B2 8/2021 Grove et al.
11,125,057 B2 9/2021 Robey
11,136,867 B2 10/2021 Robey et al.
11,156,068 B2 10/2021 Robey et al.
11,174,690 B2 11/2021 Robey et al.
11,203,928 B2 12/2021 Dubs et al.
11,359,468 B2 6/2022 Roberts et al.
11,519,246 B2 12/2022 Grove et al.
11,560,778 B2 1/2023 Grove et al.
11,566,508 B2 1/2023 Grove et al.
2009/0084552 A1* 4/2009 Behrmann ..... E21B 43/116 166/63
2010/0147519 A1 6/2010 Goodman
(Continued)

FOREIGN PATENT DOCUMENTS

GB 2420599 A 5/2006

OTHER PUBLICATIONS

International Search Report and Written Opinion for International Patent Application No. PCT/US2023/028605 dated Mar. 28, 2024. PDF file. 9 pages.

*Primary Examiner* — Caroline N Butcher
(74) *Attorney, Agent, or Firm* — John Wustenberg; C. Tumey Law Group PLLC

(57) ABSTRACT

A dampening housing that may comprise a tubular structure, a chamber disposed within the tubular structure, and a first port disposed within the tubular structure about a first end of the chamber and providing fluid communication between the chamber to a wellbore. The dampening housing may further include a piston disposed within the chamber and configured to traverse the length of the chamber.

16 Claims, 5 Drawing Sheets

(56) References Cited

U.S. PATENT DOCUMENTS

| | | | | |
|---|---|---|---|---|
| 2012/0138302 | A1* | 6/2012 | Stehle | E21B 43/116 166/63 |
| 2013/0118745 | A1 | 5/2013 | Grove et al. | |
| 2018/0195372 | A1 | 7/2018 | Robey et al. | |
| 2019/0226305 | A1 | 7/2019 | Spring et al. | |
| 2020/0270973 | A1 | 8/2020 | Baumann et al. | |
| 2021/0032963 | A1 | 2/2021 | Robey et al. | |
| 2021/0040805 | A1* | 2/2021 | Kehoe | E21B 23/04 |
| 2022/0127935 | A1 | 4/2022 | Grove et al. | |

* cited by examiner

PERFORATING FLUID SHOCK DAMPENER

BACKGROUND

After drilling various sections of a wellbore that traverse a subterranean formation, individual metal tubulars may be secured together to form a casing string that is cemented within the wellbore. The casing string may provide a path for fluids to flow from producing subterranean intervals to the surface. To allow the fluids into the casing string, the casing string may be perforated.

Typically, the perforations may be created by detonating a series of charges within the casing string. Specifically, one or more charge carriers may be loaded with the charges. The charge carriers may then be secured within a tool string that is lowered into the casing string. Once the charge carriers are positioned at a desired depth, the charges may be detonated. Upon detonation, the charges may form jets that may cause perforations through the casing string, the cement, and a portion of the subterranean formation.

The functioning of the perforating tool string can cause excessive wellbore pressure changes within the wellbore at the location of the perforation operation. These excessive wellbore pressure changes may lead to perforation tunnel collapse, excessive transient sand production, sanded-in guns, impaired/plugged perforations, suboptimal well performance, shock damage to downhole components (dislodged packers, bent/corkscrewed tubing, etc.), and/or undesirable gun movement due to the passage of excessive pressure transients.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to dampening housing, which is conveyed as part of a perforating tool, which reduces the magnitude of fluid pressure changes which may accompany perforating. The dampening housing acts as a pulsation dampener or accumulator to absorb a passing wellbore fluid shock (whether positive or negative). In examples, the dampening housing may mitigate the initial passing shock (such as due to gunfilling, or the expulsion of detonation products form the gun into the wellbore) but may also dampen out subsequent waves which may be reflected off of various surfaces in the wellbore.

Figure 1A:
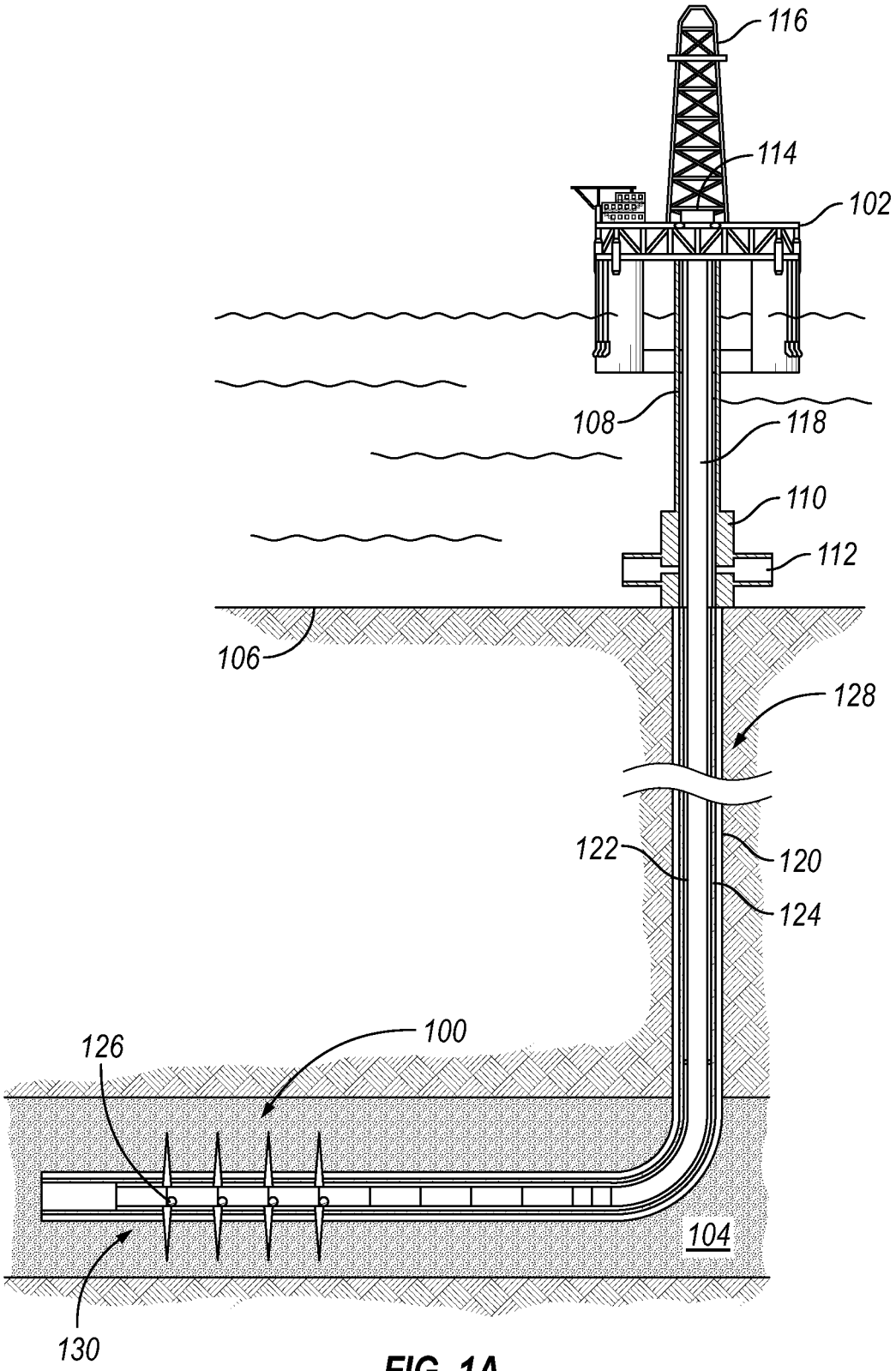
FIGS. 1A and 1B illustrates an operating environment for a perforating tool, in accordance with examples of the present disclosure.

FIG. 1 illustrates an operating environment for a perforating tool 100, in accordance with examples of the present disclosure. A semi-submersible platform ("platform 102") may be centered over a submerged oil and gas formation 104 that may be located below a sea floor 106. A subsea conduit 108 may extend from platform 102 to a wellhead installation 110 which may include subsea blow-out preventers 112. Platform 102 may include a hoisting apparatus 114 and a derrick 116 for raising and lowering pipe strings such as a work string 118 which may include the perforating tool 100.

The work string 118 may also include a conveyance such as a wireline, slickline, coiled tubing, pipe, or downhole tractor, which may provide mechanical suspension, as well as electrical connectivity, for the perforating tool 100, for example. It should be understood that the configuration of the perforating tool 100 shown on FIG. 1 is merely illustrative and other configurations of the perforating tool 100 may be utilized with the present techniques. For example, although FIG. 1 depicts an offshore environment, systems and methods of the present disclosure may also be utilized onshore.

A wellbore 120 may extend through various earth strata including formation 114. A casing string 122 may be cemented within the wellbore 120 by cement 124. The wellbore 120 may include an initial, generally vertical portion 128 and a lower, generally deviated portion 130 which is illustrated as being horizontal. It should be noted, however, by those skilled in the art that the perforating tool 100 may also be suited for use in other well configurations including, but not limited to, inclined wells, wells with restrictions, non-deviated wells, and/or multilateral wells, for example.

Perforating tool 100 may include various tools such as a plurality of perforating apparatuses or guns 126. To perforate the casing string 122, the perforating tool 100 may be lowered in the casing string 122 until the perforating guns 126 are properly positioned relative to the formation 104. Thereafter, in some examples, shaped charges (not shown) within the perforating guns 126 are detonated. Upon detonation, liners of the shaped charges may form a spaced series of perforations 129 extending outwardly through the casing string 122, the cement 124, and into the formation 104, thereby allowing fluid communication between the formation 104 and the wellbore 120.

Figure 1B:
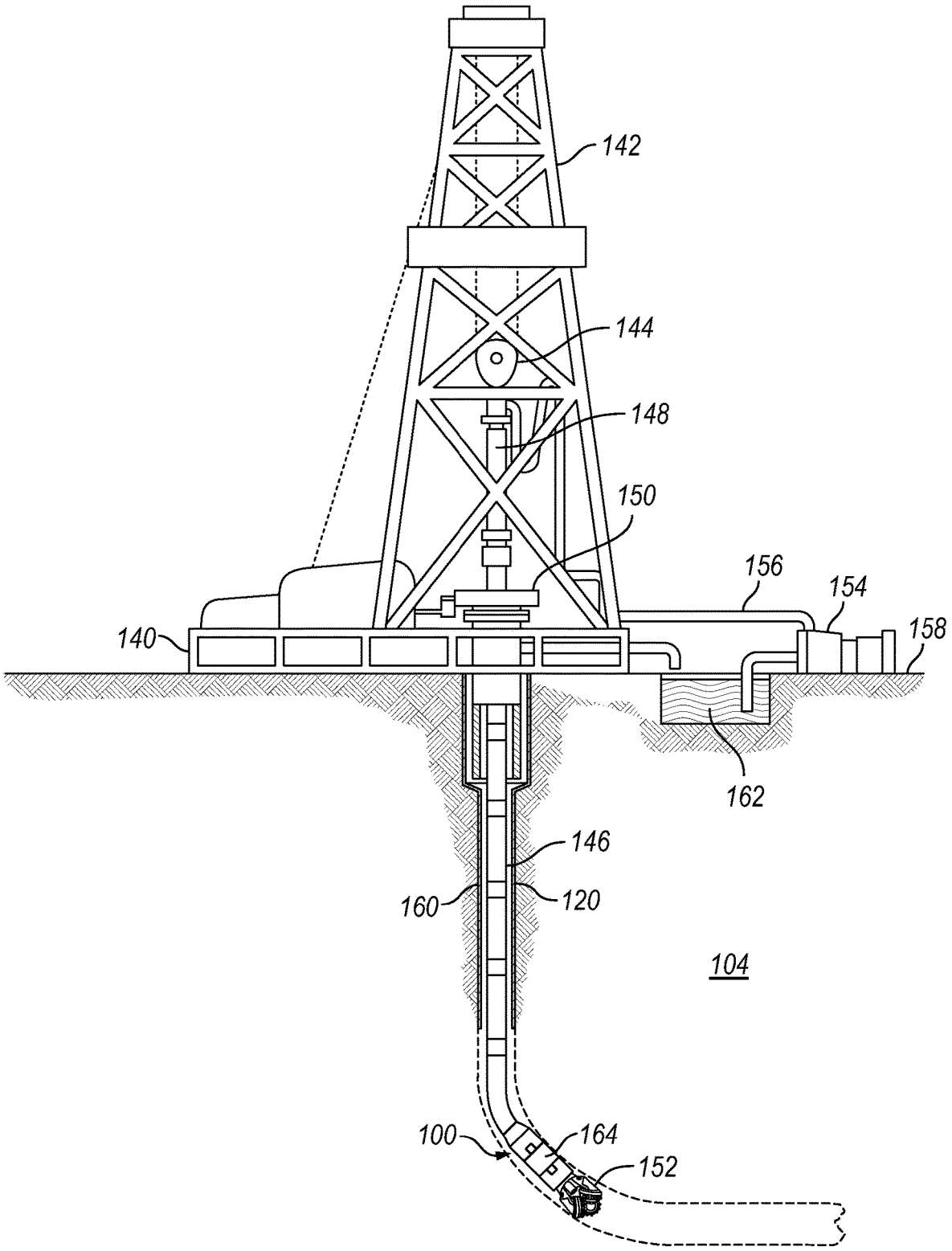

As illustrated in FIG. 1B, perforation tool 100 may also be utilized in land on a drill string 146 in a drilling operation for land operations. Perforation tool 100 may be used to perforate formation 104 to increase fluid movement of reservoir fluid within formation 104. The reservoir fluid may be contaminated with well fluid (e.g., drilling fluid) from wellbore 120. As described herein, the fluid sample may be analyzed to determine fluid contamination and other fluid properties of the reservoir fluid. As illustrated, a wellbore 120 may extend through formation 104. While wellbore 120 is shown extending generally vertically into formation 104, the principles described herein are also applicable to boreholes that extend at an angle through formation 104, such as horizontal and slanted boreholes. For example, although FIG. 1B shows a vertical or low inclination angle well, high inclination angle or horizontal placement of the well and equipment is also possible. It should further be noted that while FIG. 1B generally depicts a land-based operation, those skilled in the art will readily recognize that the principles described herein are equally applicable to subsea operations that employ floating or sea-based platforms and rigs, without departing from the scope of the disclosure.

As illustrated, a drilling platform 140 may support a derrick 142 having a traveling block 144 for raising and lowering drill string 146. Drill string 146 may include, but is not limited to, drill pipe and coiled tubing, as generally known to those skilled in the art. A kelly 148 may support drill string 146 as it may be lowered through a rotary table 150. A drill bit 152 may be attached to the distal end of drill string 146 and may be driven either by a downhole motor and/or via rotation of drill string 146 from the surface 112. Without limitation, drill bit 152 may include roller cone bits, PDC bits, natural diamond bits, any hole openers, reamers, coring bits, and the like. As drill bit 152 rotates, it may create and extend borehole 104 that penetrates various subterranean formations 106. A pump 154 may circulate drilling fluid through a feed pipe 156 to kelly 148, downhole through interior of drill string 146, through orifices in drill bit 152, back to surface 158 via annulus 160 surrounding drill string 146, and into a retention pit 162. Drill bit 152 may be just one piece of a downhole assembly that may include one or more drill collars 164 and perforation tool 100. Although a drilling operation is illustrated, perforation tool 100 may be disposed within wellbore 120 by any suitable conveyance such as wireline, coiled tubing, and/or tractor assemblies.

Figure 2:
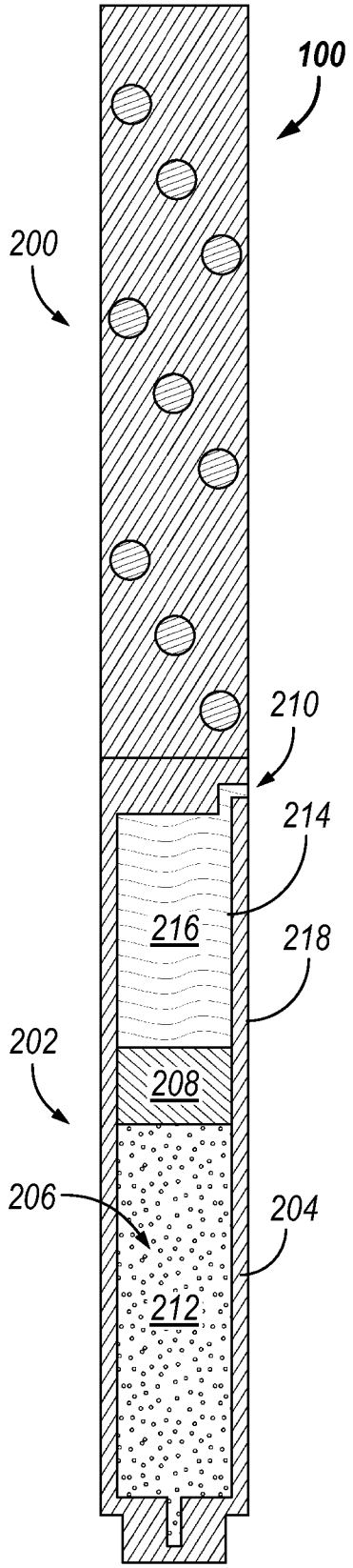
FIG. 2 illustrates a closeup view of the perforating tool, in accordance with examples of the present disclosure.

FIG. 2 illustrates a closeup view of at least a part of perforating tool 100, in accordance with examples of the present disclosure. As illustrated, perforating tool 100 may comprise perforating housing 200 and dampening housing 202, which may be connected to each other by any suitable means. For example, perforating housing 200 and dampening housing 202 may be connected by a threaded connection, a bolted connection, a latching connection, and/or the like. Additionally, perforating housing 200 and dampening housing 202 may not be directly connected to each other. For example, one or more modules or one or more housings may be disposed between perforating housing 200 and dampening housing 202. Although not illustrated, perforating housing 200 may comprise a bulkhead, electrical contact, wire, gun body, charge tube, lower charge tube, det sleeve/detonation housing, detonator assembly, end alignment, electrical bulkhead/feed thru, and retaining nut. During perforation operations, the discharge of explosives downhole in a confined area may create pressure changes within wellbore 120. Excessive pressure changes may lead to perforation tunnel collapse, excessive transient sand production, sanded-in guns, impaired/plugged perforations, suboptimal well performance, shock damage to downhole components (dislodged packers, bent/corkscrewed tubing, etc.), undesirable gun movement due to the passage of excessive pressure transients, and/or the like. For this disclosure, excessive pressure is the amount of overall pressure created by force, acoustics, and/or hydrostatics that would collapse wellbore 120. The amount of overall pressure to collapse wellbore 120 will differ based on the lithology of formation 104 (e.g., referring to FIG. 1). Dampening housing 202 may operate and function to reduce, if not prevent, the problems that may occur from pressure changes within wellbore 120 during perforation operations.

Figure 6:
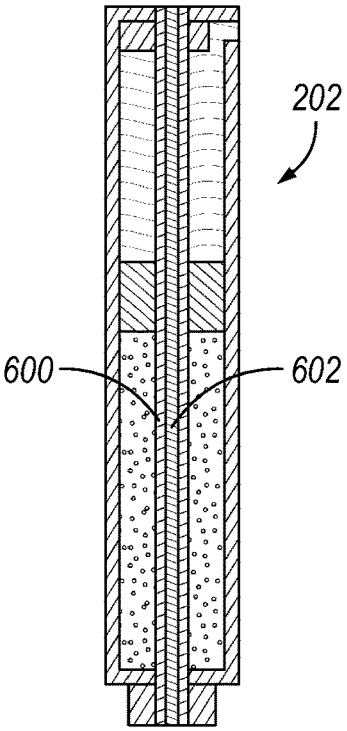
FIG. 6 illustrates an embodiment of the dampening housing with an internal mandrel.

Dampening housing 202 may comprise a tubular structure 204 that may comprise of steel. Tubular structure 204 may form a chamber 206. Chamber 206 may be any suitable size to create a suitable volume specific to the charges detonated by perforating housing 200 and the lithology of formation 104 (e.g., referring to FIG. 1). Within chamber 206 a piston 208 may be housed. In examples, piston 208 may be attached to tubular structure 204 through a friction connection. For example, piston 208 may have a height that is greater than the diameter of piston 208. Specifically, the height is captured mathematically in a ratio in which the height is greater than the diameter expressed as H/D. Additionally, the outer diameter of piston 208 may also be very close to the inner diameter of chamber 206. In other examples, as discussed below in FIG. 6, when a mandrel is present, piston 208 may have a void within the center of piston 208 which may allow piston 208 to be concentrically disposed around the mandrel. Additionally, piston 208 may be plastic, aluminum, steel, and/or other metal. Lighter weight materials such as aluminum and plastic may create a lower density within piston 208 which may allow for a fast-acting piston that is more responsive to pressure exerted within chamber 206. Furthermore, piston 208 may not comprise an O-ring. This may allow for piston 208 to be very light and have minimal friction along inner sliding surfaces of chamber 206, in order to move quickly enough to effectively respond to perforating pressure transients, discussed below. In general, piston 208 does not need to create a perfect seal, which may utilize an O-ring. To the contrary, a small amount of leakage of gas and/or fluid past piston 208 is acceptable and may not materially impact the function of dampening housing 202. Considering the required time window over which dampening housing 202 may function, and the substantially pressure-balanced state across piston 208, a hermetic seal may not be necessary anyway. This may allow for piston 208 to traverse the length of chamber 206.

At one end of chamber 206, a port 210 may be formed from an outer surface 218 of tubular structure 204 to an inner surface 214 of chamber 206. Port 210 may be of any shape, length, diameter, and/or width. As illustrated, port 210 may allow for fluid communication between wellbore 120 and chamber 206. In examples, there may be a plurality of ports 210 disposed within tubular housing 204 that may be disposed at any suitable location. This may allow for wellbore fluid 216 to enter into chamber 206 and contact piston 208. Wellbore fluid 216 may freely enter or exit chamber 206 through port 210. Piston 208 may further separate wellbore fluid 216 from a pressurized gas 212 disposed within chamber 206.

Figures 3A, 3B:
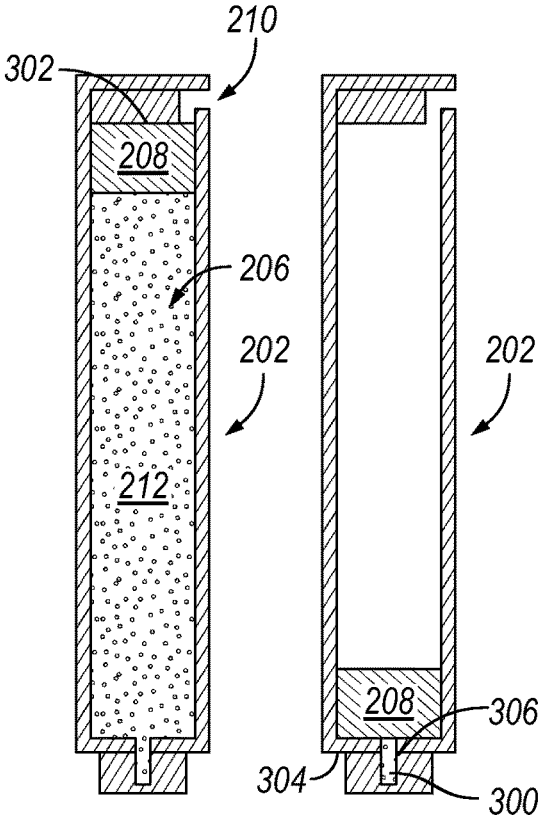
FIGS. 3A and 3B illustrate embodiments of dampening housing.

FIGS. 3A and 3B illustrate examples of dampening housing 202 charged with a pressured gas 212. In examples, pressurized gas 212 may be nitrogen, atmospheric air, carbon dioxide, and/or the like. As illustrated in FIG. 3A, before dampening housing 202 is disposed within wellbore 120, pressurized gas 212 may be pre-charged within chamber 206 (i.e., at surface, or potentially while downhole). This may move piston 208 within chamber 206 until pressure has equalized on both sides of piston 208. In examples, at surface, pressure from pressurized gas 212 may exert more force than air traversing through port 210. In such instance, piston 208 may come into contact with an end 302 of chamber 206, which may prevent further movement of piston 208 by pressurized gas 212. Alternatively, as illustrated in FIG. 3B, pressurized gas 212 may be generated in situ by a source 300. In examples, source 300 may be a propellant cartridge, gas generator, and/or explosive device. Source 300 may be activated at surface or within wellbore 120. In examples in which source 300 may be utilized, pressure from air may traverse piston 208 to a second end 304 of chamber 206 in which source 300 may be disposed. As illustrated in FIG. 3B, source 300 may be disposed within a compartment 306 in communication with chamber 206. Thus, as source 300 is activated, pressurized gas created from source 300 may traverse into chamber 206 and may move piston 208. During operations, source 300 may be activated electrically using an igniter. Activation of source 300 may allow for dampening housing 202 to operate and function during perforation operations.

Figure 4:
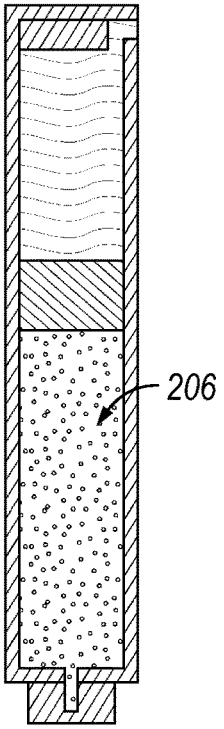
FIG. 4 illustrate and embodiment of a dampening housing before a perforation operation.

FIG. 4 illustrates dampening housing 202 disposed within wellbore 120 (i.e., referring to FIG. 1) and prepared for perforation operations. As illustrated, piston 208 may be disposed at any suitable location within chamber 206 based on pressure equilibrium reach between wellbore fluid 216 and pressured gas 212. This may allow piston 208 to subsequently travel up or down within chamber 206 in response to pressure changes of wellbore fluid 216 induced by perforating, as dampening housing 202 seeks to maintain pressure balance across piston 208.

Figure 5:
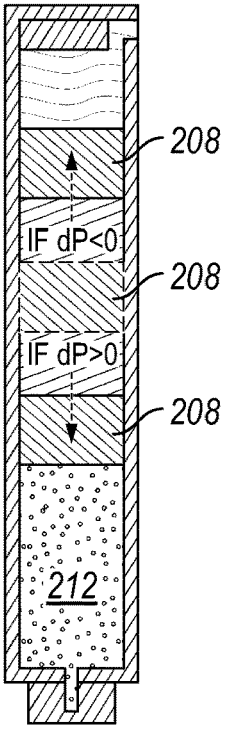
FIG. 5 illustrates possible movement of a piston within the dampening housing.

As illustrated in FIG. 5, resulting compression or expansion of wellbore fluid XXX due to perforation operations may result in an increase or decrease in pressure, respectfully, of wellbore fluid 216 upon piston 208. However, the magnitude of movement of piston 208, which is to say the magnitude of force exerted by wellbore fluid 216, is reduced (compared to an equivalent volume of liquid) due to higher compressibility of pressurized gas 212. For example, pressurized gas 212 may be mathematical described by the ideal gas law:

$$PV=nRT \quad (1)$$

Thus, compressibility is approximately 1/P, where P is pressure. In this example, downhole pressure is 15,000 psi, the compressibility is ~1/15,000 or 6.7e-5 $psi^{-1}$. For comparison the compressibility of water is ~1/300,000 or 3.3e-6 $psi^{-1}$. Per unit volume then, even highly compressed gas is ~20× more compressible than water. The larger the volume of pressurized gas 212, the more compliant the system, thus the more effective dampening housing 202 is at mitigating wellbore pressure excursions from perforation operations.

Dampening housing 202 may further comprise additional elements depending on the location of dampening housing 202 within perforation tool 100 (e.g., referring to FIG. 1). For example, in FIGS. 6, dampening housing may further comprise a mandrel 600. Mandrel 600 may be tubular and may traverse the entire length of dampening housing 202. Additionally, central mandrel 600 may be disposed within the center of dampening housing 202 or may be offset from the center of dampening housing 202 in any direction. Mandrel 600 may function and operate to allow for a detonation cord 602 to traverse through dampening housing 202 to one or more perforation housings 200 (e.g., referring to FIG. 2), which may allow for a continuous detonation train throughout perforation tool 100.

Figure 7:
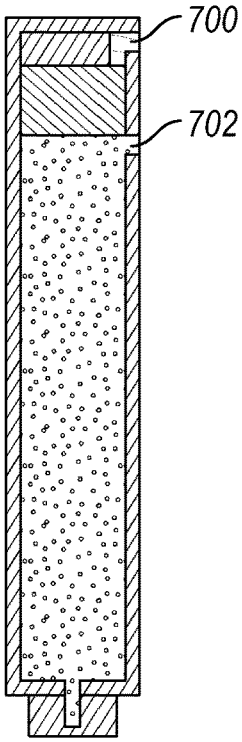
FIG. 7 illustrates and embodiment of the dampening housing with a plurality of ports.

As noted above, dampening housing 202 may comprise a plurality of ports 210 (e.g., referring to FIG. 2). FIG. 7 illustrates an example in which a first port 700 may be utilized with a second port 702. As illustrated, second port 702 may enable venting of pressurized gas 212 into wellbore 120 after perforation operations. This would be a safety/pressure-relief feature, unrelated to the essential shot-time function of dampening housing 202. It should be noted that piston 208 may not move past second port 702 during downhole operations. This is due to prior setup of piston 208 within chamber 206. For example, piston 208 is configured before operations for wellbore fluids and pressurized gas 212 to act as a pressure balanced across piston 208, allowing piston 208 to remain ~mid-stroke (+/−) (e.g., referring to FIGS. 4 and 5). However, when dampening housing 202 is removed from wellbore 120, the pressure within wellbore 120 may drop at shallower depths, causing piston 208 to travel to the top of chamber 206, allowing for second port 702 to act as a safety/pressure relief feature. Dampening housing 202 may further operate and function without the use of piston 208.

Figure 8A:
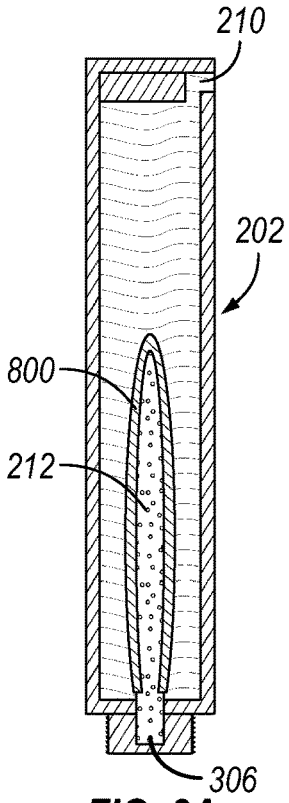
FIGS. 8A and 8B illustrate an embodiment of the dampening housing with a bladder.
Figure 8B:
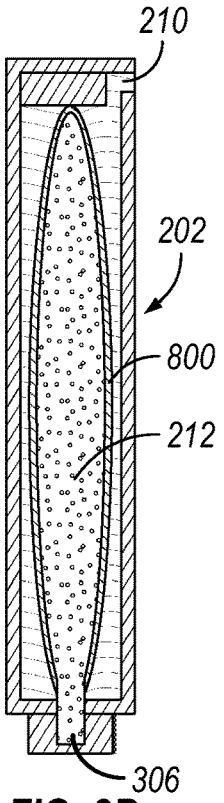

FIGS. 8A and 8B illustrate embodiments in which a bladder 800 may be disposed within dampening housing 202 instead of piston 208 (e.g., referring to FIG. 2). Embodiments illustrated in FIGS. 8A and 8B may be utilized in dynamic underbalance (DUB) and dynamic overbalance (DOB) operations. Bladder 800 may be a rubber or elastomer that is compatible with wellbore fluid experienced in a downhole environment. As illustrated in FIG. 8A, bladder 800 may attach to compartment 306 by any suitable means. For example, bladder 800 may be connected to compartment 306 by nuts and bolts, washers, pressure fittings, screws, seals, and/or the like. As discussed above, pressurized gas 212 may be disposed within bladder 800 at the surface or through a source 300 (not illustrated). Additionally, wellbore fluid 216 may enter chamber 306 through one or more ports 210 and surround bladder 800. Pressure exerted by wellbore fluid 216 upon bladder 800 may equalize based on pressurized gas 212, as discussed above. As illustrated in FIG. 8B, during a dynamic-underbalanced perforation operation, perforating housing 200 begins to fill, pulling formation fluid 216 in from wellbore 120, wellbore 120 may be replenished from formation fluid 216 in dampening housing 202. Formation fluid 216 may be expelled through port 210 with help from pressurized gas 212 as the gas volume expands.

Figure 9A:
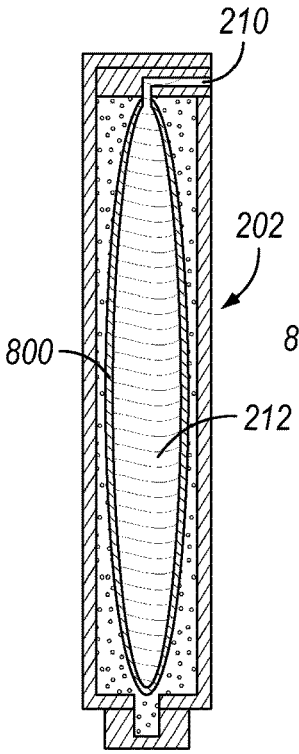
FIGS. 9A and 9B illustrate another embodiment of the dampening housing with a bladder.
Figure 9B:
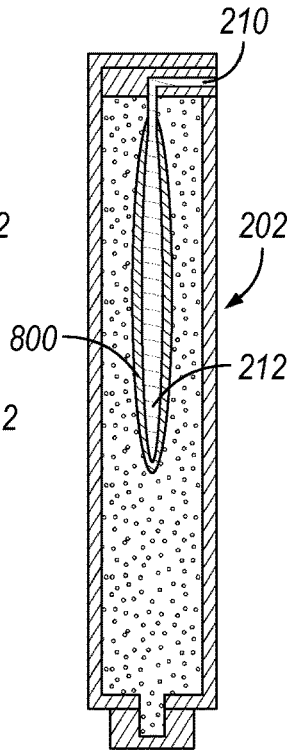

FIGS. 9A and 9B illustrate embodiments in which a bladder 800 may be disposed within dampening housing 202 instead of piston 208 (e.g., referring to FIG. 2). Embodiments illustrated in FIGS. 9A and 9B may be utilized in dynamic underbalance (DUB) and dynamic overbalance (DOB) operations. Bladder 800 may be a rubber or elastomer that is compatible with wellbore fluid experienced in a downhole environment. As illustrated in FIG. 9A, bladder 800 may attach to port 210 by any suitable means. For example, bladder 800 may be connected to compartment 306 by nuts and bolts, washers, pressure fittings, screws, seals, and/or the like. As discussed above, pressurized gas 212 may be disposed within chamber 206 and surround bladder 800 at the surface or through a source 300 (not illustrated). Additionally, wellbore fluid 216 may enter bladder 800 through one or more ports 210. Pressure exerted by wellbore fluid 216 upon bladder 800 may equalize based on pressurized gas 212, as discussed above. As illustrated in FIG. 9B, during a dynamic-underbalanced perforation operation, perforating housing 200 begins to fill, pulling wellbore fluid 216 in from wellbore 120, wellbore 120 may be replenished from wellbore fluid 216 in bladder 800. Formation fluid 216 may be expelled through port 210 with help from pressurized gas 212 as the gas volume expands, collapsing bladder 800 to squeeze formation fluid 216 out of port 210.

With reference to FIGS. 8A,8B, 9A, and 9B, gas generation from a source 300 (not illustrated) may coincide with perforation operations. In this way, rather than being a passive dampener, dampening housing 202 would be a pro-active shock preventer. Dampening housing 202 function would be timed to push a designed volume of wellbore fluid 216 into wellbore 120 just as perforating housing 200 activates. Properly timed, activating source 300 within dampening housing 202 may negate any wellbore fluid pressure pulse which would otherwise propagate along wellbore 120 and/or act on the formation 114 (e.g., referring to FIG. 1).

Figure 10:
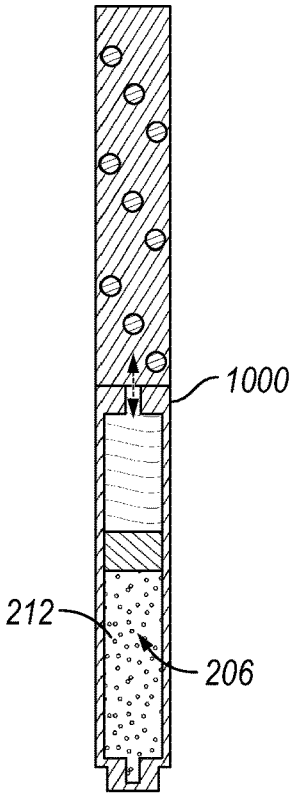
FIG. 10 illustrates and embodiment of the dampening housing in which a port connects the dampening housing to a perforation housing.
Figure 11:
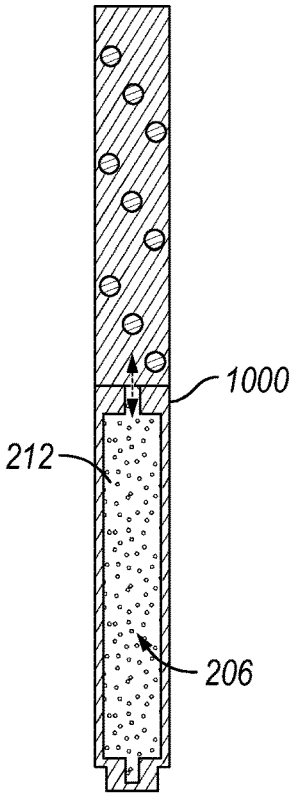
FIG. 11 illustrates another embodiment of the dampening housing in which a port connects the dampening housing to a perforation housing.

FIGS. 10 and 11 illustrate embodiments in which port 210 of dampening housing 202 may be directly connected to an interior of perforating housing 200. In this example, perforating housing 200 and dampening housing 202 may be separated by a bulkhead 1000, which would be caused to rupture at the desired time after (or coinciding with) perforation operations. This may enable subsequent communication between the internal volumes of perforating housing 200 and chamber 206 of dampening housing 202. In this case a liquid 1002 may be pushed directly into perforating housing 200 from dampening housing 202, as illustrated in FIG. 10. In examples, liquid 1002 may be water or an oil. However, in FIG. 11, piston 208 (e.g., referring to FIG. 10) and liquid 1002 (e.g., referring to FIG. 10) may be eliminated and pressurized gas 212 may be pushed directly into perforating housing 200. Thus, dampening housing 202 may not act as a dampener/accumulator to wellbore pressure fluctuations. Rather dampening housing 202 may function and operate to decrease the available in-gun volume and/or increase the in-gun pressure within perforation housing 200. Thus, reducing the extent to which wellbore fluid 216 enters perforation housing 200, and in turn reducing the magnitude and duration of any dynamic underbalance.

Systems and methods described above are improvements over current existing approaches to address dynamic underbalance (DUB) and dynamic overbalance (DOB) wellbore fluid compliance in the near-gun region. Existing approaches to mitigate the consequence of gunshock include mechanical shock absorbers (spring-based, crushable elements, etc.). These are designed to address mechanical movement and load transfer within tubulars, guns, and other solid bodies. The methods and systems discussed above reduce the magnitude of the pressure wave propagating through the wellbore fluid itself, which gives rise to mechanical movements that the shock absorbers are intended to absorb. Thus, the methods and systems reduce risk of sand production, completion damage, and operational issues, and/or increase productivity/injectivity performance. The systems and methods for reducing the magnitude of the pressure wave propagation through wellbore fluid include any of the various features of the systems and methods disclosed herein, including one or more of the following statements.

Statement 1: A dampening housing that may comprise a tubular structure, a chamber disposed within the tubular structure, a first port disposed within the tubular structure about a first end of the chamber and providing fluid communication between the chamber to a wellbore, and a piston disposed within the chamber and configured to traverse the length of the chamber.

Statement 2: The dampening housing of statement 1, further comprising a compartment disposed about a second end of the chamber.

Statement 3: The dampening housing of statement 2, wherein a source is disposed within the compartment and configured to create a pressurized gas.

Statement 4: The dampening housing of statements 1 or 2, wherein a pressurized gas is disposed between the piston and a second end of the chamber.

Statement 5: The dampening housing of any previous statements 1, 2, or 4, a second port disposed within the tubular structure between the first port and a second end of the chamber.

Statement 6: The dampening housing of any previous statements 1, 2, 4, or 5, a mandrel disposed about a center of the dampening housing and traversing the length of the dampening housing.

Statement 7: The dampening housing of statement 6, a detonation cord disposed within the mandrel.

Statement 8: The dampening housing of statement 6, wherein a void is disposed within the piston to allow for the piston to be disposed concentrically around the mandrel.

Statement 9: The dampening housing of any previous statements 1, 2, or 4-6, wherein the piston is a plastic, an aluminum, or a steel.

Statement 10: The dampening housing of statement 9, wherein the piston has a height that is greater than a diameter of the piston.

Statement 11: A dampening housing may comprising a tubular structure, a chamber disposed within the tubular structure, a first port disposed within the tubular structure about a first end of the chamber and providing fluid communication between the chamber to a wellbore, and a bladder disposed within the chamber.

Statement 12: The dampening housing of statement 11, wherein the bladder is connected to the first port.

Statement 13: The dampening housing of statement 12, wherein an inner surface of the bladder is in fluid communication with the wellbore through the first port.

Statement 14: The dampening housing of statement 12, wherein a pressurized gas is disposed between an outer surface of the bladder and inner surface of the chamber.

Statement 15: The dampening housing of any previous statements 11 or 12, further comprising a compartment disposed about a second end of the chamber.

Statement 16: The dampening housing of statements 11, 12, or 15, wherein the bladder is connected to the chamber.

Statement 17: The dampening housing of statement 16, wherein an outer surface of the bladder is in fluid communication with the wellbore through the first port.

Statement 18: The dampening housing of statement 16, wherein a pressurized gas is disposed between an inner surface of the bladder and the compartment.

Statement 19: The dampening housing of statement 16, wherein the pressurized gas is a nitrogen, an atmospheric air, or a carbon dioxide.

Statement 20: The dampening housing of any previous statements 11, 12, 15, or 16, wherein the bladder is a rubber or an elastomer.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A dampening housing comprising:

a tubular structure;

a chamber disposed within the tubular structure;

a first port disposed within the tubular structure about a first end of the chamber and providing fluid communication between the chamber to a wellbore;

a piston disposed within the chamber and configured to traverse a length of the chamber;

a mandrel disposed about a center of the dampening housing and traversing the length of the dampening housing; and wherein a void is disposed within the piston to allow for the piston to be disposed concentrically around the mandrel.

2. The dampening housing of claim 1, further comprising a compartment disposed about a second end of the chamber.

3. The dampening housing of claim 2, wherein a source is disposed within the compartment and configured to create a pressurized gas.

4. The dampening housing of claim 1, wherein a pressurized gas is disposed between the piston and a second end of the chamber.

5. The dampening housing of claim 1, a second port disposed within the tubular structure between the first port and a second end of the chamber.

6. The dampening housing of claim 1, a detonation cord disposed within the mandrel.

7. The dampening housing of claim 1, wherein the piston is a plastic, an aluminum, or a steel.

8. The dampening housing of claim 7, wherein the piston has a height that is greater than a diameter of the piston.

9. A dampening housing comprising:

a tubular structure;

a chamber disposed within the tubular structure;

a first port disposed within the tubular structure about a first end of the chamber and providing fluid communication between the chamber to a wellbore; and a bladder disposed within the chamber and connected to the first port:

wherein an inner surface of the bladder is in fluid communication with the wellbore through the first port.

10. The dampening housing of claim 9, further comprising a compartment disposed about a second end of the chamber.

11. The dampening housing of claim 9, wherein the bladder is connected to the chamber.

12. The dampening housing of claim 11, wherein an outer surface of the bladder is in fluid communication with the wellbore through the first port.

13. The dampening housing of claim 10, wherein a pressurized gas is disposed between an inner surface of the bladder and the compartment.

14. The dampening housing of claim 13, wherein the pressurized gas is a nitrogen, an atmospheric air, or a carbon dioxide.

15. The dampening housing of claim 9, wherein the bladder is a rubber or an elastomer.

16. A dampening housing comprising:

a tubular structure;

a chamber disposed within the tubular structure;

a first port disposed within the tubular structure about a first end of the chamber and providing fluid communication between the chamber to a wellbore; and a bladder disposed within the chamber and connected to the first port;

wherein a pressurized gas is disposed between an outer surface of the bladder and inner surface of the chamber.

* * * * *